US005496696A

United States Patent [19]

Patel et al.

[11] Patent Number: 5,496,696

[45] Date of Patent: Mar. 5, 1996

[54] SILVER HALIDE IMAGING MATERIALS

[75] Inventors: Ranjan C. Patel, Little Hallingbury; Kevin P. Hall, Leaden Roding, both of Great Britain

[73] Assignee: Minnesota Mining and Manufacturing Company, St. Paul, Minn.

[21] Appl. No.: 114,669

[22] Filed: Aug. 31, 1993

[30] Foreign Application Priority Data

Sep. 2, 1992 [GB] United Kingdom ..... 9218599

[51] Int. Cl.[6] ..... G03C 1/498

[52] U.S. Cl. ..... 430/619; 430/542; 430/570; 430/581; 430/613

[58] Field of Search ..... 430/619, 613, 430/570, 586, 542

[56] References Cited

U.S. PATENT DOCUMENTS

| | | | |
|---|---|---|---|
| 4,343,891 | 8/1982 | Aasen | 430/337 |
| 4,447,521 | 5/1984 | Tiers et al. | 430/337 |
| 4,558,003 | 12/1985 | Sagawa | 430/617 |
| 4,835,096 | 5/1989 | Lea | 430/619 |
| 5,260,180 | 11/1993 | Sahyun et al. | 430/542 |

FOREIGN PATENT DOCUMENTS

| | | |
|---|---|---|
| 02240648 | 9/1990 | Japan . |
| 2-240648 | 9/1990 | Japan . |
| 641348 | 8/1950 | United Kingdom . |

OTHER PUBLICATIONS

2244 Research Disclosure (1989) Mar., No. 299, New York, NY US.

*Primary Examiner*—Thorl Chea

*Attorney, Agent, or Firm*—Gary L. Griswold; Walter N. Kirn; Mark A. Litman

[57] ABSTRACT

A photosensitive element having a photosensitive medium comprising silver halide in reactive association with an organoborate salt and wherein said medium is selected from:

(a) silver halide photographic emulsions comprising a cationic dye, and (b) photothermographic media comprising in one or more layers a reducible silver source, a reducing agent for silver ion and an antifoggant.

19 Claims, No Drawings

SILVER HALIDE IMAGING MATERIALS

FIELD OF INVENTION

This invention relates to imaging materials and in particular to light sensitive silver halide grains contacted with organoborate salts and the use of the same in silver halide based imaging systems.

BACKGROUND TO THE INVENTION

The use of borate salts in imaging materials is known. For example: U.S. Pat. Nos. 4,343,891, 4,447,521 and 4,450,237 disclose the use of borate salts with cationic dyes as photoinitiators for polymerization in colour imaging media and magnetic recording media; U.S. Pat. No. 4,859,572 discloses the use of borate salts as electron donors for dye sensitised imaging systems; Japanese Patent No. 1-012143 discloses the use of borate salts with triazene compounds as high-speed photopolymerization catalysts; Japanese Patent No. 1-013141 discloses the use of borate salts with onium salts; Japanese Patent No. 2-034603 discloses the use of borate salts as high-speed polymerization catalysts, and Japanese Patent No. 2-058501 discloses the use of borate salts as antifoggants for photothermographic materials.

Japanese Patent Publication No. 2-240648 discloses photothermographic elements comprising a support having coated thereon a layer of a photosensitive medium comprising silver halide, a developer, a polymerisable compound and an organoborate salt. The photothermographic elements are exposed in an image-wise fashion to form a latent image and then heated to fully develop the image. The heat causes the polymerisable compound to polymerize in the exposed regions of the element. The photothermographic elements find particular utility in thermal-dye-transfer imaging, in which the thermally-mediated transfer of dye or other colourant to a receptor sheet is prevented in the polymerized (exposed) regions of the element. In the majority of the -examples, the photosensitive medium is prepared by dissolving the organoborate salt, together with the reducing agent in an organic solvent, e.g., dichloromethane and adding the organoborate/developer solution to a solution of the polymerisable compound and a colourant and dispersing the resulting mixture in an aqueous gelatino preparation of silver halide and silver benzotriazole. The photosensitive composition is then emulsified in an aqueous pectin solution and treated with alkali to prepare photosensitive microcapsules therefrom. The conditions of formulation are such that the organoborate salt, namely tetrabutyl ammonium tetrabutylborate, which is substantially insoluble in aqueous solution, is confined to the hydrophobic organic phase thereby preventing it from contacting the silver halide grains.

In one example (Example 3), the photosensitive element is prepared by coating the support with a first layer comprising silver behenate and a polymerizable compound which is then dried and overlaid with a second layer comprising ammonium halide, the organoborate compound and a hindered phenol developer. The exposed element is heated, typically for 20 seconds at 110° C., and then 'wet-processed' by immersion in a methanol bath to remove the photosensitive medium in the non-irradiated regions.

BRIEF SUMMARY OF THE INVENTION

According to the present invention there is provided a photosensitive element having a photosensitive medium comprising silver halide in reactive association with an organoborate salt and wherein said medium is selected from:

(a) silver halide photographic emulsions comprising a cationic dye, and (b) photothermographic media comprising in one or more layers a reducible silver source, a reducing agent for silver ion and an antifoggant.

DESCRIPTION OF PREFERRED EMBODIMENTS

Organoborate salts are known and may be synthesised by methods such as those described in U.S. Pat. Nos. 2,853,525; German Patent No. 883147; *Chem. Ber.*, 88, 962(1955); *Chem. Abstr.*, 52, 354 (1958); *Chem. Abstr.*, 52, 2667 (1958); *Chem. Abstr.*, 54, 9608 (1960); *J. Org. Chem.*, 29, 1971 (1964); *Anal. Chem. Acta.*, 32, 376 (1965); *Journal für Praktische Chemie*, 26, 15 (1964); *Journal of American Chemical Society*, 90, 5280 (1968); *Journal of American Chemical Society*, 93, 1816 (1971); *Annalen der Chemie*, 563, 110 (1949); *Annalen der Chemie*, 618, 31 (1958) and *Inorganic Chemistry*, 1, 738 (1962).

Preferred organoborate salts for use in the present invention have a nucleus of general formula (I):

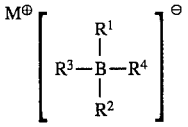

(I)

in which;

each of $R^1$ to $R^4$ independently represents a cyano group; an alkyl group comprising up to 30 carbon atoms, preferably up to 10 carbon atoms; an alkenyl group comprising up to 30 carbon atoms, preferably up to 10 carbon atoms; an alkynyl group comprising up to 30 carbon atoms, preferably up to 10 carbon atoms; an aryl group comprising up to 14 carbon atoms, preferably up to 10 carbon atoms; an aralkyl group comprising up to 14 carbon atoms, preferably up to 10 carbon atoms; a carbocyclic ring nucleus, generally comprising from 5 to 8 carbon atoms; a carbocyclic fused ring nucleus, generally comprising up to 14 carbon atoms; a heterocyclic fused ring nucleus, generally comprising from 5 to 8 ring atoms, or a heterocyclic fused ring nucleus, generally comprising up to 14 ring atoms, which ring atoms are selected from C, N, O, S and Se, each of which groups, ring nuclei and fused ring nuclei may optionally possess one or more substituents selected from alkyl groups comprising up to 5 carbon atoms, alkenyl groups comprising up to 5 carbon atoms, aryl groups comprising up to 10 carbon atoms, a nitro group, a cyano group and halogen atoms, and $M^{\oplus}$ is a cation.

Examples of suitable alkyl groups represented by $R^1$ to $R^4$ include: methyl, ethyl, propyl, isopropyl, butyl, isobutyl, t-butyl, pentyl, isopentyl, hexyl, octyl, trifluoromethyl etc.

Examples of suitable alkenyl groups include: ethenyl, propenyl, butenyl, pentenyl, hexenyl, heptenyl, octenyl, docenyl, prenyl and the like.

Examples of suitable alkynyl groups include: ethynyl, propynyl, butynyl, pentynyl, hexynyl, heptynyl etc.

Examples of suitable carbocyclic ring nuclei include: cyclopentyl, cyclohexyl, 4-methylcyclohexyl, cycloheptyl, cyclooctyl and the like.

Examples of suitable aryl groups include: phenyl, methoxyphenyl, fluorophenyl, chlorophenyl, dichlorophenyl, tolyl, xylyl, N,N-dimethylaminophenyl, naphthyl, chloronaphthyl, methoxynaphthyl, diphenylaminophenyl etc.

Examples of suitable aralkyl groups include: benzyl, phenethyl, α-naphthylmethyl, β-naphthylmethyl, p-chlorobenzyl and the like.

Examples of suitable heterocyclic ring and fused ring nuclei include pyridyl, quinolyl, lepidyl, methylpyridyl, furyl, thienyl, indolyl, pyrrolyl, carbazolyl, N-ethylcarbazolyl etc.

$M^{\oplus}$ may comprise any suitable cation including metal ions, such as $Ag^{\oplus}$. Non-acidic cations, particularly alkali metal ions, e.g., $Li^{\oplus}$, $N^{\oplus}$, $K^{\oplus}$ etc., and quaternary ammonium compounds e.g., of formula $N^{\oplus}(R^5)_4$ in which each $R^5$ independently represents an alkyl group comprising up to 5 carbon atoms or an aryl group comprising up to 10 carbon atoms, are preferred because organoborate salts are invariably acid-labile. Other suitable cations include cationic dyes, in particular cyanine dyes.

Specific examples of the borate anion are tetramethylborate, tetraethylborate, tetrabutylborate, triisobutylmethylborate, di-t-butyldibutylborate, tetra-n-butylborate, tetraphenylborate, tetra-p-chlorophenylborate, triphenylmethylborate, triphenylethylborate, triphenylpropylborate, triphenyl-n-butylborate, triphenylhexylborate, trimesitylbutylborate, tritolylisopropylborate, triphenylbenzylborate, tetraphenylborate, tetrabenzylborate, triphenylphenethylborate, triphenyl-p-chlorobenzylborate, trimethallylphenylborate, tricyclohexylbutylborate, tri(phenylethenyl)butylborate, di(α-naphthyl)dipropylborate, diisopinocamphenyldiamylborate etc.

Examples of organoborate salts suitable for use in the present invention include:

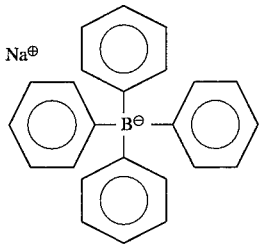

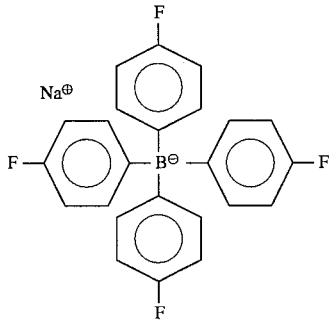

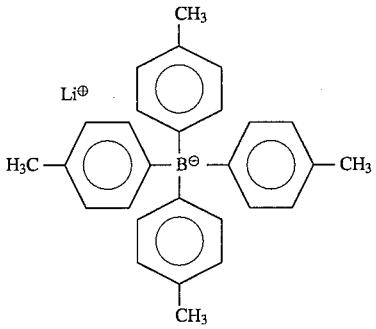

-continued

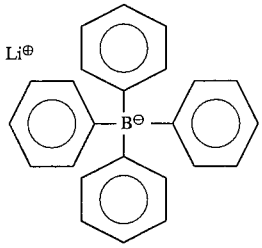

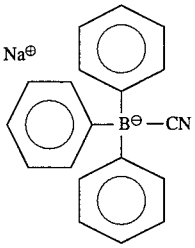

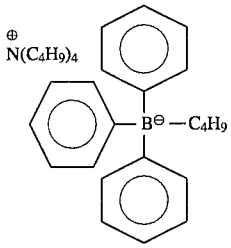

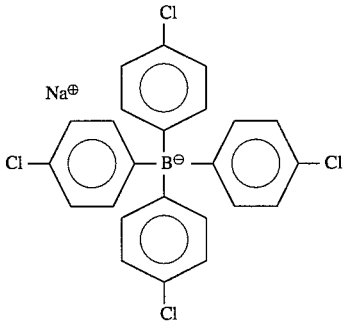

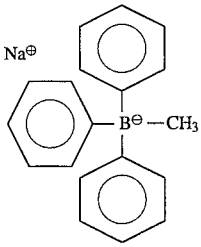

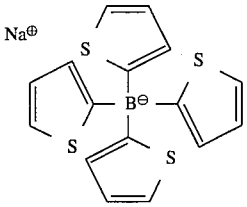

-continued

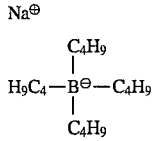

Preferred organoborate salts for use in the present invention comprise monoalkyltriarylborates, e.g., tetrabutyl ammonium n-butyltriphenylborate, and tetraarylborates, e.g., sodium tetraphenylborate. Organoborate salts comprising a tetraaryl borate anion are most preferred. Organoborate salts comprising an organoborate ion having an $E_{ox}$ of from 0.4 to 0.8 are generally preferred.

The choice of organoborate salt and the manner of its incorporation will vary with the type of imaging system. It is essential for the organoborate salt to be in reactive association with the silver halide, i.e., the organoborate is in sufficiently close physical proximity to the silver halide grains to react or otherwise affect the properties of the silver halide. It is believed there is physical contact between the organoborate and the surface of silver halide grains. For the organoborate anion to contact the silver halide grain surface, the organoborate salt must be soluble in the medium in which the silver halide grains are dispersed and be added in a manner that allows free contact with the silver halide grains. Thus, the choice of organoborate salt, as well as the manner of its incorporation, for an aqueous-based gelatin emulsion may differ from that chosen for photothermographic media which are normally coated as organic dispersions.

The organoborate salt is generally added to the silver halide (AgX) grains in an amount from $1\times10^{-1}$ to $1\times10^{-6}$ moles per mole of AgX, preferably $1\times10^{-2}$ to $1\times10^{-5}$ moles per mole of AgX. The grains may be formed of silver chloride, silver bromide, silver iodide, silver bromoiodide, silver chlorobromide, silver iodochlorobromide etc., and may comprise regular crystals of cubic, orthorhombic, tabular, octahedral or tetrahedral habit, or irregular crystals such as spherical or composite grains. The silver halide grains may be formed with a uniform phase from the core to the surface layer or they may be dissimilar in phase. It is quite permissible to use two or more independently prepared grain types of varying size, shape etc. when preparing the photosensitive elements of the invention.

The preparation of silver halide grains is well understood in the art and is described below for the preparation of a conventional silver halide emulsion layer. The process involves several distinct processes which are carried out in sequence:

(1) the formation and dispersal of the microcrystals of silver halide, including the stages of emulsification and physical ripening;

(2) the freeing of the emulsion containing the silver halide grains from excess soluble salts by washing, or by coagulation followed by redispersal in a salt-free medium, and (3) a heat treatment, known as after ripening, digestion, or chemical sensitising, to obtain the desired light sensitivity. Several of these processes are often merged into one operation in practise and in some cases one of more steps may be eliminated from manufacturing procedures.

Generally, the silver halide is precipitated and emulsified by reaction of a halide solution (typically alkali metal or ammonium halide) and a silver salt (usually silver nitrate) in the presence of an emulsifying agent, which is usually gelatin. The halide and silver solutions are mixed, preferably under fixed conditions of temperature, concentration, sequence of addition and rate of addition to produce the dispersion. Two precipitation schemes are commonly used known as the single-jet and double-jet methods respectively. In the single-jet method, all of the halide is in the mixing vessel right from the start, and the silver nitrate solution is gradually added. In the double-jet scheme, the halide solution and the silver nitrate solution are added simultaneously to the gelatin solution which is in the mixing vessel.

Subsequent to, or concurrent with, the precipitation and emulsification process occurs the first ripening, termed physical ripening, which involves maintaining the dispersion in the presence of a solvent for the silver halide to permit the coalescence and recrystallisation of the individual particles to the desired crystal (grain) sizes. This ripening stage is intended to establish the grain size and distribution of sizes.

When the desired degree of ripening is reached, an additional emulsifying agent (gelatin) may be added and the emulsion cooled and permitted to set to a firm jelly. It is then divided into small fragments, usually by squeezing through a grid under pressure, and the soluble salts and ammonia are washed from the emulsion with chilled water by osmotic diffusion.

In the course of formation of silver halide grains or in the process of physical ripening, there may be added to the silver halide emulsion a cadmium salt, lead salt, thallium salt, rhodium salt or rhodium complex salt, iridium salt or complex salt, ruthenium salt or complex salt, or mixture of such salts or the like. Gelatin is preferably used as the binder or protective colloid for the photographic emulsion, but other hydrophilic colloids and extenders known in the art can also be employed. For example, other useful materials might include gelatin derivatives, graft copolymers of gelatin to other high polymers, proteins such as albumin and casein, cellulose derivatives such as hydroxyethyl cellulose, carboxymethyl cellulose, cellulose sulphate esters etc., sugar derivatives such as sodium alginate, starch derivatives etc., and synthetic homopolymers or copolymers such as poly(vinyl alcohol), poly(vinyl pyrrolidone), poly(acrylates), poly(methacrylates), poly(acrylamide), poly(vinyl imidazole) and poly(vinyl pyrazole).

Before washing, the emulsion generally has low sensitivity and low contrast. During the after-ripening, or chemical sensitising stage, the grains undergo important changes in their sensitivity to light. Further details on the formation of silver halide grains can be found in Chapter 2 of the "Theory of the Photographic Process" by C. E. K. Mees and T. H. James (3rd Edition MacMillan Press (1971).

The organoborate salt is preferably added to the silver halide grains during the formation of the emulsion, typically during or after physical ripening. The organoborate salt is generally added to the silver halide grains dissolved in a suitable solvent such as water, methanol, or dimethylformamide, preferably in combination with a cationic sensitising dye. It is believed that cationic dye associates with the organoborate anion, and helps to bring it into contact with the silver halide grain surface. The organoborate salt may also be added during one or more stages in the preparation of the photosensitive element itself, e.g., as a separate coating additive. During the addition of the organoborate salt, the temperature is desirably kept below 60° C. and more preferably below 50° C. to prevent fogging of the photosensitive element. The former method of contacting the silver halide with the organoborate salt is found to enhance the shelf life of photosensitive elements prepared therefrom. The organoborate salt is thought to be in reactive or otherwise catalytic association with the surface of the silver halide grains, typically, as a deposit or epitaxial growth of silver organoborate.

The organoborate treated silver halide grains of the invention are normally prepared as an emulsion for ease of handling and may be incorporated into conventional 'wet' silver halide photographic materials comprising a spectrally sensitised silver halide emulsion where they are found to improve the sensitometric properties of the emulsion, i.e., the presence of the organoborate salt supersensitises the emulsion layer. Preferred cationic dyes include cyanine dyes, where the sensitometric effect is most pronounced.

The photographic emulsion may also be chemically sensitised. Known methods for chemical sensitisation of silver halide emulsions include sulphur sensitisation, reduction sensitisation and noble metal sensitisation. Chemical sensitisation may be effected by any one or a combination of such methods.

The usual method of the noble metal sensitisation is gold sensitisation and for this purpose, a gold compound, generally a complex salt of gold, is utilized. Complex salts of other noble metals such as platinum, palladium, rhodium etc., may also be used. Examples of this method are described in U.S. Pat. No. 2,448,060 and British Patent No. 618061.

Sulphur sensitisers include, in addition to sulphur compounds contained in gelatin, various sulphur compounds such as thiosulphates, thiourea compounds, thiazoles and rhodanines.

Other supersensitisers may also be employed.

The photographic emulsions may be high contrast, e.g., lith films, containing a hydrazine compound or other additives known in the art. Such materials are disclosed, for example, in U.S. Pat. Nos. 2,322,027, 2,419,974, 2,419,975, 4,166,742, 4,168,977, 4,211,857, 4,224,401, 4,743,739, 4,272,606, 4,272,614, 4,311,781 and 4,323,643.

The photographic emulsions may also include a variety of compounds for the prevention of fog during production, storage or photographic processing or for the purpose of stabilising the photographic qualities of the emulsion. Such compounds are commonly referred to as antifogging agents or stabilisers and include: azole compounds (e.g., as benzothiazolium salts, nitroimidazoles, chlorobenzimidazoles, bromobenzimidazoles, mercaptothiazoles, mercaptobenzothiazoles, nitrobenzothiazoles etc.), mercaptopyrimidines, thioketo compounds (e.g., oxazolinethione etc.), azaindenes (e.g., triazaindene), tetraazaindenes (particularly, 4-hydroxy-substituted- 1,3,3a,7-tetraazaindenes, pentaazaindenes etc.), benzenethiosulphonic acid, benzenesulphinic acid, benzenesulphonamide etc. Amongst these compounds, benzotriazoles (e.g., 5-methylbenzo-triazole) and nitroindazoles (e.g., 5-nitroindazole) are preferred. These compounds may also be incorporated in the processing solution.

The photographic emulsions may also contain inorganic or organic hardening agents such as chromium salts (e.g., chrome alum, chromium acetate etc.), aldehydes (e.g., formaldehyde, glyoxal, glutaraldehyde etc.), N-methylol compounds (e.g., dimethylolurea, methylol-dimethylhydantoin etc.), dioxane derivatives (e.g., 2,3,-dihydroxydioxane etc.), active vinyl compounds (e.g., 1,3,5 triacryloyl-hexahydro-s-triazines, 1,3,-vinyl-sulphonyl-2-propanol etc.), active halogen compounds (e.g., 2,4,-dichloro-6-hydroxy-s-triazine etc.), mucohalogenic acids (e.g., mucochloric acid, mucophenoxy-chloric acid etc.), and the like may be used. These hardening agents may be incorporated alone or in combination.

The photographic emulsion may also comprise a variety of surface active agents for various purposes, such as the improvement of coating properties, antistatic properties, slip properties, emulsion dispersibility, anti-adhesion properties, and photographic properties (for example, development acceleration, increase in contrast, sensitisation etc.).

Nonionic surfactants may be employed such as saponin (steroidal), alkylene oxide derivatives (e.g., polyethylene glycol, polyethylene glycol/polypropylene glycol condensate, polyethylene glycol alkyl ethers, polyethylene glycol alkyl arylethers, polyethylene glycol esters, polyethylene glycol sorbitan esters, polyalkylene glycol alkylamines or alkylamides, silicone polyethylene oxide adducts), glycidol derivatives (e.g., alkenylsuccinic acid polyglyceride, alkylphenol polyglyceride), polyhydric alcohol-fatty acid esters, sugar alkyl esters etc.

Anionic surfactants containing acid groups, such as a carboxyl group, a sulpho group, a phospho group, a sulphuric acid ester group, a phosphoric acid ester group etc., for example alkylcarboxylates, alkylsulphonates, alkylbenzenesulphonates, alkylnaphthalenesulphonates, alkylsulphuric acid esters, alkylphosphoric acid esters, n-acyl-n-alkyltaurines, sulphosuccinic acid esters, sulphoalkylpolyoxyethylene alkylphenyl ether, polyoxyethylene alkylphosphoric acid esters etc., may also be used.

Amphoteric surfactants, such as amino acids, aminoalkylsulphonic acids, aminoalkylsulphuric or phosphoric acid esters, alkylbetaines, amine oxides etc.; and cationic surfactants, such as alkylamines, aliphatic or aromatic quaternary ammonium salts, heterocyclic quaternary ammonium salts, such as pyridinium salts, heterocyclic quaternary ammonium salts, such as pyridinium salts, imidazolium salts etc., aliphatic or heterocyclic ring-containing phosphonium or sulphonium salts etc., may also be used.

The photographic emulsion layer may further comprise a matting agent, such as silica, magnesium oxide, polymethyl methacrylate etc., for the purpose of preventing adhesion.

Photographic elements incorporating such photographic emulsions are generally prepared by coating a layer of the emulsion onto a support comprising an opaque material such as paper or a transparent film base such as cellulose triacetate, cellulose diacetate, nitrocellulose, polystyrene, polyester, polyethylene terephthalate or the like.

There is no particular limitation on the developing agents that can be employed as a consequence of treating the silver halide with organoborate salts. Thus, for example, dihydroxybenzenes (e.g., hydroquinone), 3-pyrazolidones (e.g., 1-phenyl-3-pyrazolidone, 4,4-dimethyl- 1-phenyl-3-pyrazolidone), aminophenols (e.g., 4-methylaminophenol) etc., can be used alone or in combination depending on the particular emulsion selected.

The photographic emulsion may be adapted for the production of black and white or coloured images. In the former case, the image is formed directly by reduction of the silver halide to metallic silver by the developer. In the latter case, the formation or destruction of a coloured dye is mediated by the action of oxidised developer. In the most common type of colour imaging, oxidised developer (normally a p-phenylenediamine derivative) reacts with one or more colour couplers to produce one or more dyes of the desired colour. For full-colour imaging, three or more emulsion layers may be necessary, each sensitised to a different wavelength, and each capable of generating a different colour. This type of imaging is well-known in the art, and is described, for example, in "Imaging Processes and Materials" (Ed. Sturge, Walworth, Shepp) (Van Nostrand 1989) pp 118–129. An alternative method of colour imaging is the silver dye bleach system described in the same reference, pp 129– 133.

High quantum efficiency silver halide latent image formation is a process of considerable commercial interest due to the needs of media being developed for laser address systems, as applied in imagesetters, laser imagers etc. The use of organoborate salts to treat silver halide grains has also been found to be useful in photothermographic compositions comprising a reducible silver source in addition to silver halide grains. Two types of imaging applications are therefore possible:

(a) conventional wet-developed silver halide materials, as described above, and (b) photothermographic "dry silver" type materials which can be thermally developed with a reducing agent, e.g., conventional dry silver developers, to yield black and white or coloured image.

Extension of the intrinsic U.V. and blue sensitivity of the photothermographic media to visible and near infrared regions may be achieved by the use of conventional spectral sensitisers, particularly cyanine, merocyanine and oxonol dyes, the use of which is well known in the art.

Therefore, in another embodiment of the invention, there is provided a photosensitive element having a photothermographic imaging medium comprising in one or more binder layers: silver halide grains in reactive association with an organoborate salt; a reducible silver source; an antifoggant and a reducing agent for silver ion.

Heat-developable silver halide photothermographic imaging materials, often referred to as "dry silver" compositions because no liquid development is necessary to produce the final image, are known and are disclosed in, e.g., U.S. Pat. Nos. 3,152,904, 3,457,075, 3,839,049, 3,985,565, 4,022,617 and 4,460,681, and in "Thermally Processed Silver Systems" by D. Morgan and B. Shely, *Imaging Processes and Materials,* Neblette's Eighth Edition, Edited by Sturge et al., (1989).

These materials generally comprise: a light-insensitive, reducible silver source; a light-sensitive material which generates silver when irradiated, and a reducing agent for the silver source. The light-sensitive material is generally photographic silver halide which must be in catalytic proximity to the light-insensitive silver source. "Catalytic proximity" is an intimate physical association of these two materials so that when silver specks or nuclei are generated by the irradiation or light exposure of the photographic silver halide, those nuclei are able to catalyse the reduction of the silver source by the reducing agent. It has been long understood that silver is a catalyst for the reduction of silver ions and the silver-generating light-sensitive silver halide catalyst progenitor may be placed into catalytic proximity with the silver source in a number of different fashions, such as partial metathesis of the silver source with a halogen-containing source (e.g., as disclosed in U.S. Pat. No. 3,457,075), coprecipitation of the silver halide and silver source material (e.g., as disclosed in U.S. Pat. No. 3,839,049) and any other method which intimately associates the silver halide and the silver source. Exposure of the silver halide to light produces small clusters of silver atoms. The imagewise distribution of these clusters is known in the art as the latent image. This latent image generally is not visible by ordinary means and the light sensitive article must be further processed in order to produce a visual image. Although stable at ambient temperatures, when heated after imagewise exposure to higher temperatures, silver is produced in the exposed regions of the medium through a redox reaction between the reducible silver source (acting as an oxidising agent) and the reducing agent. This redox reaction is accelerated by the catalytic action of the exposure generated silver atoms. The silver contrasts with the unexposed areas to form the image. Alternatively, the reducing agent may be such that it generates a colour on oxidation, either by itself becoming coloured, or by releasing a dye during the process of oxidation. The resulting colour image may optionally be diffused thermally to a separate receptor layer.

Photothermographic elements are usually constructed as one or two imaging layers on a support. Single layer constructions must contain the reducible silver source, the silver halide, the reducing agent, the antifoggant and usually a binder as well as optional additives, such as toners, coating aids and other adjuvants. Two layer constructions must contain at least the reducible silver source and silver halide in one layer (typically the layer adjacent to the support) with the other ingredients in the second layer or in both layers.

In a preferred embodiment, the photosensitive element comprises a support having coated thereon a first binder layer comprising the silver halide grains and the reducible silver source and a second binder layer comprising the reducing agent and antifoggant.

The reducible silver source may comprise any material which contains a reducible source of silver ions. Silver salts of organic acids, particularly long chain (from 10 to 30, preferably 15 to 28 carbon atoms) fatty carboxylic acids are preferred. Complexes of organic or inorganic silver salts in which the ligand has a gross stability constant for silver ion of between 4.0 and 10.0 are also useful. Examples of suitable silver salts are disclosed in Research Disclosure Nos. 17029 and 29963. The preferred silver salt is silver behenate. The silver source generally comprises from about 5 to 70%, preferably from 7 to 45% by weight of the imaging layer. The presence of a second layer in a two-layer construction does not unduly affect the amount of the silver source used.

The silver halide may be any photosensitive silver halide such as silver bromide, silver iodide, silver chloride, silver bromoiodide, silver chloroiodide, silver chlorobromoiodide etc., and may be added to the imaging layer(s) in any fashion which places it in catalytic proximity to the reducible silver source. The silver halide generally comprises from 0 75 to 15% preferably 1 to 10% and more preferably 1.5 to 7% by weight of the imaging layer, although larger amounts up to 20 or 25% are useful. The silver halide may be prepared in situ by conversion of a portion of silver soap by reaction with halide ions or it may be preformed and added during soap generation. The latter is preferred as organoborate treated preformed silver halide is found to have a better shelf life.

The reducing agent for silver ion may comprise any conventional photographic developer, such as phenidone, hydroquinones and catechol, although hindered phenols are preferred. The reducing agent generally comprises from 1 to 10% by weight of the imaging layer, but in a two-layer construction, if the reducing agent is in the second layer, slightly higher proportions, of from 2 to 15%, tend to be more desirable. Toning agents such as phthalazinone, and both phthalazine and phthalic acid, and others known in the art, are not essential to the construction, but are highly desirable. These materials may be present, for example, in amounts of from 0.2 to 12 percent by weight.

The developer or, where the photothermographic medium includes a toning agent, the developer and toning agent together, must be capable of interacting with and fogging the reducible silver source in the exposed regions of the element during thermal processing. Examples of suitable developers and toning agents are disclosed in U.S. Pat. Nos. 3,770,448, 3,773,512 and 3,893,863 and Research Disclosure Nos. 17029 and 29963. The preferred toner is phthalazinone.

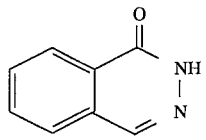

Preferred developers are of the formula:

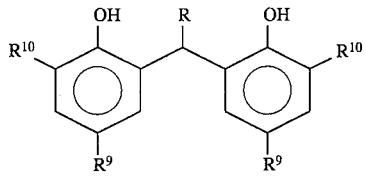

in which;

R represents hydrogen or an alkyl group comprising up to 10, generally up to 5 carbon atoms, and each $R^9$ and $R^{10}$ independently represents hydrogen or an alkyl group of up to 5 carbon atoms.

The photothermographic chemistry may be black and white or colour-forming. In the latter type of material, the reducing agent generates a colour on oxidation either by becoming coloured itself, or by releasing a dye during the process of oxidation. Any leuco dye capable of being oxidized by silver ion to form a visible dye is useful in the practice of the present invention. Dye-forming developers such as those disclosed in U.S. Pat. Nos. 3,445,234, 4,021,240, 4,022,617, 4,368,247 and 4,460,681 are useful, and also those disclosed in Japanese Patent Publication No. 82-500352, and likewise dye-releasing developers, such as those disclosed in U.S. Pat. No. 4,981,775.

It is essential to include an effective antifoggant in the photothermographic materials of the invention since, without an antifoggant, some generation of silver in the unexposed areas takes place upon thermal development, resulting in a poor differential between the image and background fog. In conventional photothermographic materials, the most effective antifoggant has been mercuric ion, but it is surprisingly found that mercury is ineffective as an antifoggant in the photothermographic materials of the present invention, and non-mercury antifoggants, for example, halogenated compounds, as disclosed in U.S. Pat. Nos. 4,546,075 and 4,452,885 and Japanese Patent Publication No. 59-57234 are preferred.

Particularly preferred non-mercury antifoggants comprise a heterocyclic compound bearing one or more substituents represented by $—CX^1X^2X^3$ where $X^1$ and $X^2$ are halogen (e.g., F, Cl, Br and I) and $X^3$ is hydrogen or halogen, such as those compounds disclosed in U.S. Pat. No. 4,756,999. Examples of suitable antifoggants include:

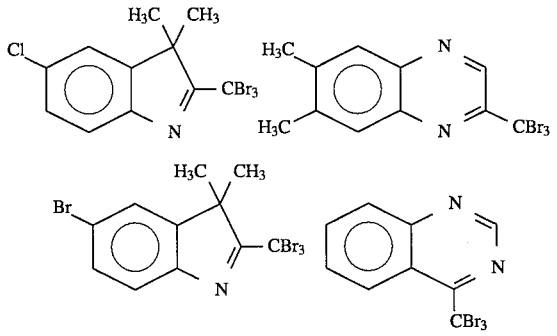

-continued

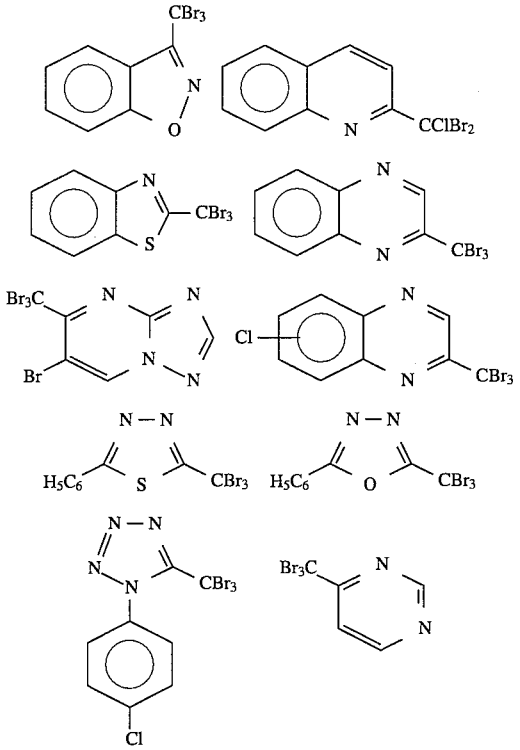

Further highly-suitable non-mercury antifoggants include heterocyclic compounds bearing one or more substituents represented by $$—\overset{\overset{\displaystyle O}{\|}}{C}—CX^1X^2X^3$$

or $—SO_2X^1X^2X^3$ when $X^1$ to $X^3$ have the same definition as before, as disclosed in our copending UK Patent Applications Nos. 9221383, 9300147 and 9311790. Also suitable are the hydrobromic acid salts of nitrogen-containing heterocyclic compounds associated with a pair of bromine atoms, as disclosed in U.S. Pat. No. 5,028,523.

The photothermographic chemistry of the element is typically applied to the support in a binder. A wide range of binders may be employed in the various layers of the photothermographic element. Suitable binders are transparent or translucent, are generally colourless and include natural polymers, synthetic resins, polymers and copolymers and other film forming media such as: gelatin, gum arabic, poly(vinyl alcohol), hydroxyethyl cellulose, cellulose acetate, cellulose acetate butyrate, poly(vinyl pyrrolidine), casein, starch, poly(acrylate), poly(methylmethacrylate), poly(vinyl chloride) poly(methacrylate), poly(styrene-maleic anhydride), poly(styrene-acrylonitrile), poly(styrene-butadiene), poly(vinyl acetals), poly(vinyl formal), poly(vinyl butyral), poly(esters), poly(urethanes), phenoxy resins, poly(vinylidene chloride), poly(epoxides), poly(carbonates), poly(vinyl acetate), cellulose esters, poly(amides) and other similar solvent-soluble binders. The binders may range from thermoplastic to highly crosslinked, and may be coated from aqueous or organic solvents or an emulsion. Preferred binders include poly(vinyl butyral) and similar materials.

Photothermographic elements in accordance with the invention are prepared by simply coating a suitable support or substrate with the one or binder layers containing the necessary photothermographic chemistry. Each layer is generally coated from a suitable solvent using techniques known in the art. Exemplary supports include materials such as paper, polyethylene-coated paper, polypropylene-coated paper, parchment, cloth and the like; sheets and foils of such metals as aluminium, copper, magnesium and zinc; glass and-glass coated with such metals as chromium, chromium alloys, steel, silver, gold and platinum; synthetic polymeric materials such as poly(alkyl methacrylates), e.g., poly(methyl methacrylate), poly(esters), e.g., poly(ethylene terephthalate), poly(vinylacetals), poly(amides), e.g., nylon, cellulose esters, e.g., cellulose nitrate, cellulose acetate, cellulose acetate propionate, cellulose acetate buyrate, and the like.

It is not essential for the photothermographic elements of the invention to comprise a separate support since each binder layer containing the photothermographic chemistry may be cast to form a self-supporting film.

The support may be sub-coated with known subbing materials such as copolymers and terpolymers of vinylidene chloride with acrylic monomers (such as acrylonitrile and methyl acrylate) and unsaturated dicarboxylic acids (such as itaconic acid or acrylic acid); carboxymethyl cellulose, poly(acrylamide); and similar polymeric materials.

The support may also carry a filter or antihalation layer, such as one comprising a dyed polymer layer which absorbs the exposing radiation after it passes through the radiation-sensitive layer and eliminates unwanted reflection from the support.

The photothermographic media of the invention may optionally include a free radical polymerisable resin, but with the important proviso that the developer and free radical polymerisable resin may not be present in the same layer or, in the case of single layer media, in the same phase. Thus, one permissible construction of photosensitive element has a photosensitive medium comprising in a first binder layer silver halide grains in reactive association with an organoborate salt, a reducible silver source, an antifoggant and a free radical polymerisable resin and in a second binder layer the reducing agent for silver ion and optionally a toner.

The invention will now be described with reference to the following Examples in which:

(a) Preformed Silver Behenate I (Full Soap) is a homogenate of: silver behenate (10 wt %); silver bromide (1 wt %) and Butvar B-76 (1 wt %) in methyl ethyl ketone, made up according to known procedures.

(b) Non-preformed Silver Behenate I (Full Soap): as (a) above but omitting the silver bromide.

(c) Preformed Silver Behenate II: silver behenate-silver bromide homogenate (10% in methyl ethyl ketone containing 0.5% Butvar B-76, 3 ml).

(d) Developer I is

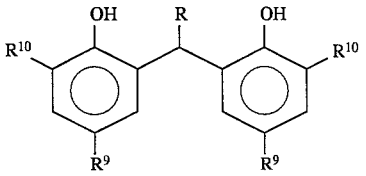

(e) Toner I is

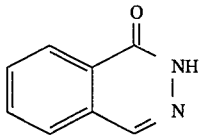

(f) Antifoggant I is

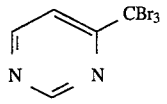

(g) Antifoggant II is

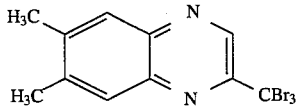

(h) Antifoggant III is

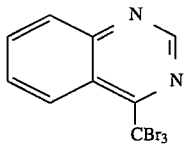

(i) Antifoggant IV is

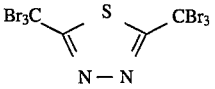

(j) Antifoggant V is

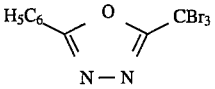

Cyanine Dye V $R^6=C_2H_5$, $R^8=—OCH_3$ and X=Br

Cyanine Dye VI $R^6=CH_3$, $R^8=H$ and X=tetraphenyl borate

Cyanine Dye VII $R^6$ $CH_3$, $R^8=H$ and $X=CH_3C_6H_4SO_3^{\ominus}$ (o) Merocyanine Dye I is

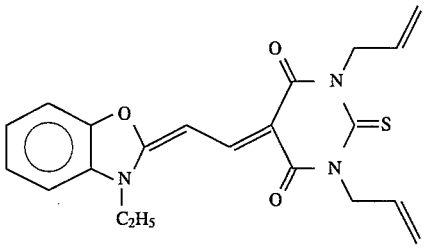

(p) Borate Salt I is sodium tetraphenylborate,

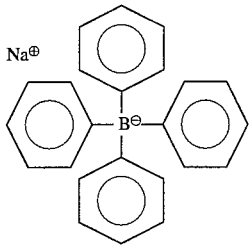

and (q) Borate Salt II is tetrabutyl ammonium n-butyltriphenylborate.

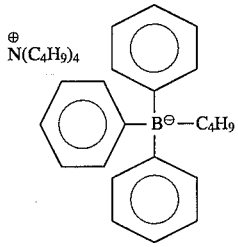

EXAMPLE 1

This Example demonstrates the use of silver halide grains in photoreactive association with an organoborate ion in photothermographic elements prepared in accordance with the invention.

Photothermographic Elements Nos. 1 to 7 were prepared as follows by sequentially coating a photosensitive layer as defined in Table 1 below and a developer layer of defined formulation onto unsubbed polyester.

TABLE 1

| | Photosensitive Layer | | | | | | |
|---|---|---|---|---|---|---|---|
| | Element No.* | | | | | | |
| Formulation (g) | 1 (c) | 2 (c) | 3 | 4 | 5 | 6 | 7 |
| Performed Silver Behenate I (Full Soap) | 10 | 10 | 10 | 10 | 10 | 10 | 10 |
| Cellulose Acetate Butyrate CAB 381-20 | 1 | 1 | 1 | 1 | 1 | 1 | 1 |
| Borate Salt I | — | — | 0.004 | 0.004 | 0.004 | 0.004 | 0.004 |
| Antifoggant I | — | — | 0.05 | — | — | — | — |
| Antifoggant II | — | 0.5 | — | 0.05 | — | — | — |
| Antifoggant III | — | — | — | — | 0.05 | — | — |
| Antifoggant IV | — | — | — | — | — | 0.05 | — |
| Antifoggant V | — | — | — | — | — | — | 0.05 |

*(c) = photosensitive element not in accordance with the invention.

Each of the above coating mixtures was prepared under red light by diluting the silver behenate homogenate with methanol (5 g) and methyl ethyl ketone (5 g) and then adding the organoborate salt and antifoggant as appropriate and mixing for 1 hour. The mixtures were coated on unsubbed polyester at 100 μm wet thickness using a knife edge and dried at 30° C. for 1 hour.

Developer Layer

Developer I (0.3 g), Toner (0.1 g) and CAB 381-20 (1 g) were dissolved in methanol (5 g) and methyl ethyl ketone (5 g) and then coated on top of the light sensitive layer at a wet thickness of 75 μm and dried for 1 hour at 30° C.

Each element was given an exposure of 0.1 units from a 6 kW NU-ARC metal halide source. Individual pieces of each exposed element were then heated for 10 seconds at different temperatures and the Dmin/Dmax values measured for the unexposed and exposed areas. The results are tabulated in Table 2 below.

TABLE 2

| Element | Developed | Development Temperature (°C.) | | | | | |
|---|---|---|---|---|---|---|---|
| No.* | Density | 100 | 110 | 120 | 130 | 140 | 150 |
| 1(c) | Dmax | 0.11 | 0.13 | 0.13 | 0.26 | — | — |
| | Dmin | 0.10 | 0.12 | 0.12 | 0.17 | — | — |
| 2(c) | Dmax | 0.06 | 0.07 | 0.06 | 0.19 | 0.37 | 0.69 |
| | Dmin | 0.05 | 0.06 | 0.06 | 0.08 | 0.10 | 0.11 |
| 3 | Dmax | — | — | — | 0.60 | — | — |
| | Dmin | — | — | — | 0.09 | — | — |
| 4 | Dmax | 0.06 | 0.08 | 0.15 | 0.21 | 2.25 | 2.47 |
| | Dmin | 0.06 | 0.07 | 0.08 | 0.09 | 0.13 | 0.19 |
| 5 | Dmax | 0.06 | 0.07 | 0.09 | 0.22 | 0.48 | 1.26 |
| | Dmin | 0.05 | 0.05 | 0.06 | 0.08 | 0.11 | 0.12 |
| 6 | Dmax | — | — | — | 0.76 | — | — |
| | Dmin | — | — | — | 0.19 | — | — |
| 7 | Dmax | — | — | — | 1.29 | — | — |
| | Dmin | — | — | — | 0.05 | — | — |

*(c) = photosensitive element not in accordance with the invention.

The results show that improved image differentials are provided by Elements Nos. 3 to 7 in accordance with the invention.

EXAMPLE 2

Photothermographic Elements Nos. 8 to 16 were prepared by sequentially coating a light sensitive layer as defined in Table 3 and a developer layer of defined formulation onto unsubbed polyester.

TABLE 3

| | Photosensitive layer | | | | | | | | |
|---|---|---|---|---|---|---|---|---|---|
| | Element No. | | | | | | | | |
| Formulation | 8 (c) | 9 (c) | 10 | 11 (c) | 12 (c) | 13 | 14 (c) | 15 (c) | 16 |
| Preformed Silver Behenate II (Full Soap) (ml) | 10 | 10 | 10 | 10 | 10 | 10 | 10 | 10 | 10 |
| Cellulost acetate butyrate (g) | 0.2 | 0.2 | 0.2 | 0.2 | 0.2 | 0.2 | 0.2 | 0.2 | 0.2 |
| Methyl ethyl ketone (ml) | 2 | 2 | 2 | 2 | 2 | 2 | 2 | 2 | 2 |
| Borate Salt II (g) | — | — | 0.02 | — | — | 0.02 | — | — | 0.02 |
| Cyanine Dye I (g) | 0.005 | 0.005 | 0.005 | — | — | — | — | — | — |
| Merocya- | — | — | — | 0.005 | 0.005 | 0.005 | — | — | — |

TABLE 3-continued

| Formulation | Photosensitive layer Element No. 8 (c) | 9 (c) | 10 | 11 (c) | 12 (c) | 13 | 14 (c) | 15 (c) | 16 |
|---|---|---|---|---|---|---|---|---|---|
| nine Dye I (g) | | | | | | | | | |
| Oxonol Dye I (g) | — | — | — | — | — | — | 0.005 | 0.005 | 0.005 |
| Anti-foggant I (g) | — | 0.05 | 0.05 | — | 0.05 | 0.05 | — | 0.5 | 0.05 |

*(c) = photosensitive element not in accordance with the invention.

Each of the above coating mixtures was prepared by the successive addition of sensitising dye, cellulose acetate butyrate, methyl ethyl ketone and, where applicable, organoborate salt and antifoggant to the silver behenate homogenate. The organoborate salt was dissolved in methyl ethyl ketone before addition to the precoating mixture. The resulting mixture was mixed for 1 hour in the dark before coating at 100 μm wet thickness onto unsubbed polyester. The coated layer was dried in the dark for 30 minutes at 30° C.

Developer Layer

A mixture of Developer I (0.3 g) and Toner I (0.1 g) in cellulose acetate butyrate (10 ml of a 10% w/w solution in methyl ethyl ketone) was coated at 75 μm wet thickness onto the dried light sensitive layer and allowed to dry for 30 minutes at 30° C. in the dark.

Each element was exposed with an argon-ion laser (1 mW), spot size 25 μm and the minimum exposure time required to produce an image on development noted (127° C./10 seconds on a hot platen in red light). The results are given in Table 4 below.

TABLE 4

| Element No.* | Sensitiser Dye | Anti-foggant I | Borate Salt II | Minimum Dwell Time (s/cm**) |
|---|---|---|---|---|
| 8(c) | Cyanine Dye I | — | — | Fogged on development |
| 9(c) | Cyanine Dye I | X | — | 0.01 |
| 10 | Cyanine Dye I | X | X | 0.001 |
| 11(c) | Merocyanine Dye I | — | — | Fogged on development |
| 12(c) | Merocyanine Dye I | X | — | 0.01 |
| 13 | Merocyanine Dye I | X | X | 0.001*** |
| 14(c) | Oxonol Dye I | — | — | Fogged on development |
| 15(c) | Oxonol Dye I | X | — | 0.1 |
| 16 | Oxonol Dye I | X | X | 0.001 |

*(c) = photosensitive element not in accordance with the invention.
** = seconds taken per 1 cm track; 25 μm laser spot size, 1 mW nominal power at 488 nm
*** = seconds taken per 1 cm track; 25 μm laser spot size, 0.25 mW nominal power at 488 nm It is clear from the results that organoborate salts:

(a) readily photoreduce preform silver bromide-silver behenate formulations yielding good latent image development centres with a clear enhancement in imaging sensitivity, and (b) cause thermographic fogging, thus reducing image latitude.

However, the addition of the antifoggant leads to suppression of the thermal fogging action of Borate Salt II but not the all important photochemical activity, e.g., compare Photosensitive Elements No. 8 and 9 (without borate and with and without antifoggant) and Photosensitive Element No. 10 (with both antifoggant and borate). Good image selectivity is obtained with very good development latitude when Antifoggant I is combined with the organoborate salt.

Substitution of ammonium tetrabutyl n-butyltriphenylborate by sodium tetraphenylborate has a similar effect, i.e., the photochemical effect is present but no thermal fogging effect is observed.

EXAMPLE 3

This Example demonstrates the use of silver halide grains in photoreactive association with an organoborate ion in conventional silver halide emulsions prepared in accordance with the present invention.

Sodium tetraphenylborate (Borate salt I) was added to a conventional silver halide graphic arts type emulsion systems as a solution (in dimethylformamide) with a variety of cationic sensitising dyes. Any effect was noted as a change in sensitometric values of the photographic film. Different exposures were made to ascertain whether there was any change in the intrinsic (i.e., blue speed) sensitivity of the emulsion as well as any changes in the dyed sensitivity. Other measurements taken include wedge spectrograms and dye absorption spectra (diffuse reflectance).

The following systems were investigated:

1. Red-sensitised silver halide emulsions using Cyanine Dyes II and III.
2. Infrared-sensitised silver halide emulsions using Cyanine Dye IV.
3. Blue-sensitised silver halide emulsions using Cyanine Dye V.

1. Red-sensitised silver halide emulsions

A silver chlorobromide emulsion (64:36) was prepared by the conventional double jet process under conditions which yielded an average grain size of approximately 0.25 μm. After removal of unwanted salts, the emulsion was chemically sensitised with sulphur and gold compounds.

Cyanine Dyes II and III were added as solutions to separate samples of the emulsion, together with different amounts of sodium tetraphenylborate at the levels given in Table 7 below. Other finalling additions were:

TRITON X-200 (4% solution) 10 ml per mole AgX, and formaldehyde (4% solution) 40 ml per mole AgX.

Each emulsion was then coated at 3.9 g $Ag/m^2$ onto subbed polyester with no antihalation layer. A conventional topcoat was used. The photosensitive elements so produced were exposed using a xenon flash with an appropriate filter (see Table 7) Following exposure; each element was developed in conventional 3M RDCII chemistry and fixer in a TR17 processor. The results obtained for the speed and Dmin of each element are given in Table 5 below.

TALBE 5

Effect of Sodium Tetraphenylborate on red-sensitised emulsions

| Element No.* | Dye | Dye level (mole:mole AgX) | Dye/Borate I ratio (mole:mole) | Exposure Type** | Speed Relative Log E) | Dmin |
|---|---|---|---|---|---|---|
| 17(c) | Cyanine II | $1.35 \times 10^{-4}$ | 1:0 | 1 | 1.57 | 0.11 |
| 18 | Cyanine II | $1.35 \times 10^{-4}$ | 1:0.06 | 1 | 1.74 | 0.20 |
| 19 | Cyanine II | $1.35 \times 10^{-4}$ | 1:0.5 | 1 | 1.96 | 0.14 |
| 17(c) | Cyanine II | $1.35 \times 10^{-4}$ | 1:0 | 2 | 2.77 | 0.12 |
| 18 | Cyanine II | $1.35 \times 10^{-4}$ | 1:0.06 | 2 | 2.81 | 0.19 |
| 19 | Cyanine II | $1.35 \times 10^{-4}$ | 1:0.5 | 2 | 3.01 | 0.16 |
| 20(c) | Cyanine III | $8.45 \times 10^{-5}$ | 1:0 | 1 | 1.30 | 0.06 |
| 21 | Cyanine III | $8.45 \times 10^{-5}$ | 1:0.1 | 1 | 1.55 | 0.58 |
| 22 | Cyanine III | $8.45 \times 10^{-5}$ | 1:0.5 | 1 | 1.74 | 0.62 |
| 23 | Cyanine III | $8.45 \times 10^{-5}$ | 1:1 | 1 | 1.52 | 0.12 |
| 24 | Cyanine III | $8.45 \times 10^{-5}$ | 1:1.5 | 1 | 1.50 | 0.07 |
| 20(c) | Cyanine III | $8.45 \times 10^{-5}$ | 1:0 | 2 | 2.65 | 0.05 |
| 21 | Cyanine III | $8.45 \times 10^{-5}$ | 1:0.1 | 2 | 2.98 | 0.44 |
| 22 | Cyanine III | $8.45 \times 10^{-5}$ | 1:0.5 | 2 | 3.10 | 0.59 |
| 23 | Cyanine III | $8.45 \times 10^{-5}$ | 1:1 | 2 | 2.93 | 0.08 |
| 24 | Cyanine III | $8.45 \times 10^{-5}$ | 1:1.5 | 2 | 2.82 | 0.07 |

*(c) = photosensitive element not in accordance with the invention.
**1 = exposure through 580 nm narrow cut interference filter.
2 = exposure through a No. 47B Wratten filter.

It is clear from the above results that the addition of the organoborate salt has a significant effect on the speed and minimum density of the films in both the dye sensitised and natural (blue) sensitivity of the emulsion. By utilising the correct level of organoborate salt it is possible to obtain a significant speed increase with little change in minimum density (Dmin).

To test whether an other organoborate salt having a different oxidation potential is also effective as a supersensitiser for red-sensitised silver-halide emulsions, replicate experiments were carried out but using tetrabutyl ammonium n-butyl triphenylborate (Borate Salt II) in place of sodium tetraphenyl borate (Borate Salt I). The results obtained with Cyanine Dye II are given in Table 6 below.

TABLE 6

The effect of an alternative organoborate salt on red-sensitised

| Element No.* | Dye | Dye level (mole:mole AgX) | Dye/Borate II ratio (mole:mole) | Exposure Type | Speed Relative Log E) | Dmin |
|---|---|---|---|---|---|---|
| 25(c) | Cyanine II | $9 \times 10^{-5}$ | 1:0 | 1 | 1.58 | 0.05 |
| 26 | Cyanine II | $9 \times 10^{-5}$ | 1:1 | 1 | 1.74 | 0.07 |
| 27 | Cyanine II | $9 \times 10^{-5}$ | 1:1.5 | 1 | 1.72 | 0.07 |
| 25(c) | Cyanine II | $9 \times 10^{-5}$ | 1:0 | 2 | 2.62 | 0.05 |
| 26 | Cyanine II | $9 \times 10^{-5}$ | 1:1 | 2 | 2.67 | 0.06 |
| 27 | Cyanine II | $9 \times 10^{-5}$ | 1:1.5 | 2 | 2.65 | 0.08 |

*(c) = photosensitive element not in accordance with the invention.

Borate salt II also has a super sensitiser effect.

2. Infrared-sensitised silver halide emulsions

Samples of the silver chlorobromide emulsion prepared in (1) above were sensitised with Cyanine Dye IV as described for Cyanine Dyes II and III. Different levels of sodium tetraphenylborate were added concomitantly with the dye solution in the same volumes of dimethyl formamide solvent. The sensitometry of the resulting photosensitive elements is given in Table 7 below.

TABLE 7

Effect of Sodium Tetraphenylborate on infrared-sensitised emulsions

| Element No.* | Dye | Dye level (mole:mole AgX) | Dye/Borate I ratio (mole:mole) | Exposure Type** | Speed Relative Log E) | Dmin |
|---|---|---|---|---|---|---|
| 28(c) | Cyanine IV | $2.54 \times 10^{-5}$ | 1:0 | 3 | 1.82 | 0.07 |
| 29 | Cyanine IV | $2.54 \times 10^{-5}$ | 1:0.1 | 3 | 1.98 | 0.11 |
| 30 | Cyanine IV | $2.54 \times 10^{-5}$ | 1:0.5 | 3 | 1.89 | 0.30 |
| 31 | Cyanine IV | $2.54 \times 10^{-5}$ | 1:1 | 3 | 2.00 | 0.12 |
| 28(c) | Cyanine IV | $2.54 \times 10^{-5}$ | 1:0 | 2 | 2.96 | 0.05 |
| 29 | Cyanine IV | $2.54 \times 10^{-5}$ | 1:0.1 | 2 | 3.10 | 0.09 |
| 30 | Cyanine IV | $2.54 \times 10^{-5}$ | 1:0.5 | 2 | 3.14 | 0.36 |
| 31 | Cyanine IV | $2.54 \times 10^{-5}$ | 1:1 | 2 | 3.21 | 0.12 |

*(c) = photosensitive element not in accordance with the invention.
**3 = exposure through an 800 nm narrow cut interference filter.

Significant speed increases in the infrared and blue spectral regions are seen, together with Dmin increases.

3. Blue-sensitised silver halide emulsions

Further samples of the silver chlorobromide emulsion prepared in (1) above were sensitised with Cyanine Dye V together with various levels of sodium tetraphenylborate in dimethylformamide solvent.

The resulting photosensitive elements were exposed with a xenon flash through a No. 47B Wratten filter. The sensitometric results are shown in Table 8 below.

TABLE 8

| Element No.* | Dye | Dye level (mole:mole AgX) | Dye/Borate I ratio (mole:mole) | Exposure Type | Speed Relative Log E) | Dmin |
|---|---|---|---|---|---|---|
| | | Effect of Sodium Tetraphenylborate on blue-sensitised emulsions | | | | |
| 32(c) | Cyanine V | $6.89 \times 10^{-4}$ | 1:0 | 2 | 2.96 | 0.07 |
| 33 | Cyanine V | $6.89 \times 10^{-4}$ | 1:0.04 | 2 | 3.10 | 0.05 |
| 34 | Cyanine V | $6.89 \times 10^{-4}$ | 1:0.13 | 2 | 3.14 | 0.05 |
| 35 | Cyanine V | $6.89 \times 10^{-4}$ | 1:0.2 | 2 | 3.21 | 0.05 |

*(c) = photosensitive element not in accordance with the invention.

It is clear from the results that the presence of the organoborate salt again increases the speed of the photosensitive elements but in this case without a concomitant increase in the minimum density.

EXAMPLE 4

This Example demonstrates the effect of adding cyanine dye-organoborate salts to silver halide photographic emulsions.

Cyanine Dyes VI and VII were dissolved in dimethyl formamide and added to the silver-chlorobromide emulsion prepared in Example 3(1) in the amounts shown in Table II below. The tetraphenyl borate salt (Cyanine Dye VI) of the simple monomethine benzothiazole cyanine dye was prepared by metathesis of the tosylate salt (Cyanine Dye VII). After coating onto photographic film base, the sensitometry was measured for exposed and processed film. The results are presented in Table 9 below.

TABLE 9

| Element No.* | Dye | Dye Level (mole:mole AgX) | Exposure Type** | Speed Relative Log E) |
|---|---|---|---|---|
| 36(c) | — | — | 4 | 2.64 |
| 37 | Cyanine VI | $2.07 \times 10^{-5}$ | 4 | 2.84 |
| 38 | Cyanine VI | $4.15 \times 10^{-5}$ | 4 | 2.92 |
| 39(c) | Cyanine VII | $2.07 \times 10^{-5}$ | 4 | 2.80 |
| 40(c) | Cyanine VII | $4.15 \times 10^{-5}$ | 4 | 2.90 |

*(c) = photosensitive element not in accordance with the invention.
**4 = exposure by a 1 μs Xenon flash through a neutral density filter.

It can be seen that for a given level of dye, greater speeds may be achieved with the organoborate-containing dye.

"EXCELERATE", "NU-ARC" and "TRITON" are all trade names/designs.

We claim:

1. A photosensitive element having a photosensitive medium comprising silver halide in reactive association with an organoborate salt and wherein said medium is a photothermographic media comprising in one or more layers a reducible silver source, a reducing agent for silver ion and an antifoggant, wherein said element comprises a support having coated thereon a first layer comprising the silver halide, the reducible silver source, the organoborate salt and the antifoggant, and a second layer comprising the reducing agent for silver ion.

2. A photosensitive element according to claim 1 wherein the antifoggant comprises a non-mercury antifoggant which comprises a heterocyclic compound bearing one or more substituents selected from the group consisting of:

$$-CX^1X^2X^3 \quad -\overset{\overset{\displaystyle O}{\|}}{C}-CX^1X^2X^3$$

and $-SO_2X^1X^2X^3$ where $X^1$ and $X^2$ are halogen and $X^3$ is selected from the group consisting of hydrogen and halogen.

3. A photosensitive element as claimed in claim 2 in which antifoggant is selected from the group consisting of:

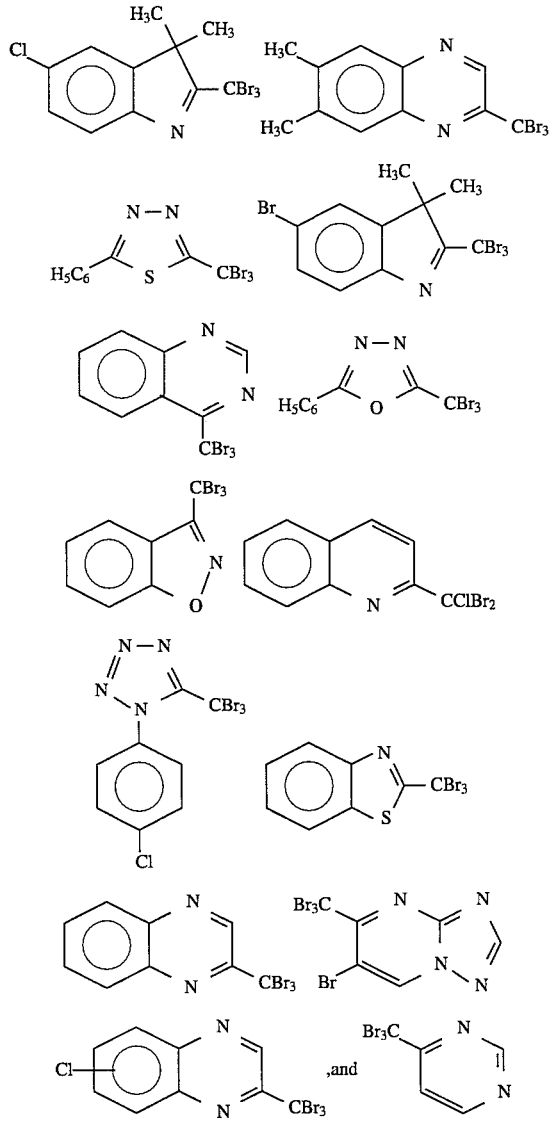

4. A photosensitive element according to claim 1 wherein said reducing agent for silver ion is selected from the group consisting of phenidone, hydroquinone, catechol and hindered phenols of the formula:

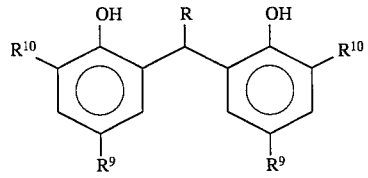

in which;

R is hydrogen or an alkyl group comprising up to 10 carbon atoms, and each $R^9$ and $R^{10}$ independently selected from the group consisting of hydrogen and alkyl groups of up to 5 carbon atoms.

5. A photosensitive element according to claim 1 wherein the photosensitive medium further comprises a toning agent.

6. A photosensitive element according to claim 5 wherein the toning agent is selected from the group consisting of phthalazinone, phthalazine and phthalic acid.

7. A photosensitive element according to claim 1 wherein the organoborate salt has a nucleus of general formula (I):

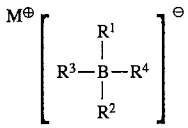

(I)

in which;

each of $R^1$ to $R^4$ are independently selected from the group consisting of a cyano group; an alkyl group comprising up to 30 carbon atoms; an alkenyl group comprising 30 carbon atoms; an aryl group comprising up to 14 carbon atoms; an aralkyl group comprising up to 14 carbon atoms; and carbocyclic ring or fused ring nucleus, or a heterocyclic ring or fused ring nucleus, each of which groups and nuclei may optionally possess one or more substituents selected from the group consisting of alkyl groups comprising up to 5 carbon atoms, alkenyl groups comprising up to 5 carbon atoms, aryl groups comprising up to 10 carbon atoms, a nitro group, a cyano group and halogen atoms, and $M^{\oplus}$ is a cation.

8. A photosensitive element according to claim 7 wherein each of $R^1$ to $R^4$ are independently selected from the group consisting of an alkenyl group consisting up to 10 carbon atoms, an alkynyl group comprising up to 10 carbon atoms, an aryl group comprising up to 10 carbon atoms, an alkoxy group comprising up to 10 carbon atoms, an aryloxy group comprising up to 10 carbon atoms, a 5,6,7 or 8-membered carbocyclic ring nucleus, a carbocyclic fused ring nucleus comprising up to 14 carbon atoms, a 5,6,7 or 8-membered heterocyclic ring nucleus and a heterocyclic ring nucleus comprising up to 14 ring atoms.

9. A photosensitive element according to claim 7 wherein the organoborate salt is selected from the group consisting of a tetraarylborate and a monoalkyl triarylborate salt.

10. A photosensitive element according to claim 9 wherein $R^1$ and $R^4$ are independently selected from the group consisting of methyl, ethyl, propyl, isopropyl, butyl, isobutyl, t-butyl, pentyl, isopentyl, hexyl, octyl, trifluoromethyl, ethenyl, propenyl, butenyl, pentenyl, hexenyl, heptenyl, octenyl, dodecenyl, prenyl, ethynyl, propynyl, butynyl, pentynyl, hexynyl, heptynyl, cyclopentyl, cyclohexyl, cycloheptyl, cyclooctyl, phenyl, fluorophenyl, chlorophenyl, dichlorophenyl, tolyl, xylyl, N,N-dimethylaminophenyl, naphthyl, chloronaphthyl, methoxynaphthyl, diphenylaminophenyl, phenoxy, naphthoxy, benzodioxy, p-tolyoxy, benzyl, phenethyl, α-naphthylmethyl, β-naphthylmethyl, p-chlorobenzyl, pyridyl, quinolyl, lepidyl, methylpyridyl, furyl, theinyl, indolyl, pyrrolyl, carbazolyl and N-ethylcarbazolyl.

11. A photosensitive element according to claim 10 wherein the organoborate salt comprises a tetraphenylborate or n-butyltriphenylborate anion.

12. A photosensitive element according to claim 7 wherein the organoborate anion has an Eox of from 0.4 to 0.8.

13. A photosensitive element according to claim 7 wherein the cation is selected from the group consisting of an alkali metal ion, a dye cation and a quaternary ammonium compound of the formula $N^+(R^5)_4$ in which each $R^5$ is independently selected from the group consisting an alkyl group comprising up to 10 carbon atoms and an aryl group comprising up to 10 carbon atoms.

14. A photosensitive element according to claim 7 wherein the organoborate salt is present in the form of deposit or an epitaxial growth of silver organoborate on the surface of the grains of silver halide.

15. A photosensitive element according to claim 1 wherein the reducible silver source comprises a silver salt or complex of an organic or hetero-organic acid.

16. A photosensitive element according to claim 15 wherein the reducible silver source is silver behenate.

17. A photosensitive element according to claim 1 wherein the photosensitive media also comprises a cyanine, merocyanine or oxonol dye as a sensitiser therefor.

18. A photosensitive element having a photosensitive medium comprising silver halide in reactive association with an organoborate salt wherein said medium is a silver halide photothermographic media comprising in one or more layers silver halide, a reducible silver source, a reducing agent for silver ion, a binder, and an antifoggant.

19. The element of claim 1 wherein a cationic dye is associated with said organoborate salt.

* * * * *